United States Patent [19]

Webster

[11] Patent Number: 4,535,498

[45] Date of Patent: Aug. 20, 1985

[54] SUSPENSION BRIDGE

[76] Inventor: David R. Webster, 320 Victoria Ave., Westmount, Quebec, Canada, H3Z 2M8

[21] Appl. No.: 485,041

[22] Filed: Apr. 14, 1983

[51] Int. Cl.[3] ..... E01D 11/00

[52] U.S. Cl. ..... 14/18; 14/20

[58] Field of Search ..... 14/1, 18, 19, 20, 21, 14/22, 23, 8, 9

[56] References Cited

U.S. PATENT DOCUMENTS

| | | | |
|---|---|---|---|
| 311,064 | 1/1885 | Davis | 14/21 |
| 510,064 | 12/1893 | Eddy | 14/19 |
| 629,902 | 8/1899 | Gunn | 14/21 |
| 660,827 | 10/1900 | Waddell | 14/36 |
| 680,906 | 8/1901 | Arnodin | 14/8 |
| 1,453,084 | 4/1923 | Strauss | 14/19 |
| 2,062,983 | 12/1936 | Baticle | 14/18 |
| 2,079,095 | 5/1937 | Wichert | 14/4 |
| 2,380,183 | 7/1945 | Maney | 14/18 |
| 2,417,825 | 3/1947 | Janke, Sr. | 14/19 |
| 2,634,122 | 4/1953 | Wolfard | 14/18 |
| 3,953,980 | 5/1976 | Bennett | 14/18 |

FOREIGN PATENT DOCUMENTS

| | | | |
|---|---|---|---|
| 0872796 | 2/1953 | Fed. Rep. of Germany | 14/1 |
| 1235973 | 3/1967 | Fed. Rep. of Germany | 14/18 |
| 0078056 | 4/1962 | France | 14/18 |
| 0447247 | 3/1968 | Switzerland | 14/18 |
| 0693423 | 7/1953 | United Kingdom | 14/1 |

*Primary Examiner*—Stephen J. Novosad
*Assistant Examiner*—Bruce M. Kisliuk
*Attorney, Agent, or Firm*—Charles A. Brown; Charles E. Brown

[57] ABSTRACT

A bridge structure comprising at least one pair of upstanding spaced apart rigid mast-towers and a rigid boom-like member extending upwardly and angularly respective each mast-tower. At least a tie member joining the free end of each boom-like member with the free end of its adjacent mast-tower, the tie member having a substantially fixed length and serving to support the boom-like member off the mast-tower. An elongated deck extending beneath the boom-like members and supported from above by a plurality of tie members, the tie members depending downwardly from each boom-like member free end, to define a pair of fan-like configurations. In a further embodiment of the invention, a pair of such structures are utilized, such being arranged in face-to-face relation. In a still further embodiment, a third deck structure is interposed intermediate the two face-to-face structures. In a still further embodiment, the two structures less the decks and their supporting tie members, are utilized as a cable support.

23 Claims, 9 Drawing Figures

SUSPENSION BRIDGE

BACKGROUND OF THE INVENTION (a) Field of the Invention

The present invention relates to bridges and particularly to suspension bridges. It further relates to cable carrying structures and a method of bridge construction.

(b) Description of Prior Art

Known suspension bridges normally have towers set in water a distance from shore, the present invention replaces such towers by inclined spars or booms leaning from shore and over the water to points corresponding to tower tops. The normal arrangement of cables for a suspension bridge is replaced in the present invention by cable systems. In one embodiment according to the invention, a first system helps to support the lean of the spars. A second system helps to support a length of deck centered under the spar tops, half the deck length extending to the spar base at shore, the other half, a counter-weight extending oppositely an equal distance beyond the spar top. This second system accordingly supports a deck portion near shore, somewhat like an elongated swing, suspended by several inclined hangers from the spar tops. A third system supports all the deck at mid span lying between the extremities of the second system at both shores. Oscillation of the deck is dampened by overlapping the suspension systems. This embodiment and others are discussed hereinafter in detail together with other aspects of the invention.

Suspension bridges have been known from antiquity as made of twisted hemp or vines for ropes, where a single rope served for the feet and two higher ropes for the hands. Sometimes a second foot rope permitted having cross-pieces tied, for a deck, and such primitive bridges still are made.

Modern suspension bridges normally have two towers set in water, spaced from shore about a sixth to a fourth of the water width, both towers supporting at their tops two or more cables draped from shore-to-shore. Hung off these cables are secondary cables supporting a traffic deck. Metal is put to such effective use in suspension bridges, compared to other bridge types, that the light weight is prone to oscillation. A common practice therefore is to stiffen against oscillation by utilizing inclined cable bracing or trusses or both. The stiffening does not contribute directly to spanning a gap but the added weight of stiffening is a necessary burden for practical bridging. Stiffening is retained in the present invention, but the stiffening is used to contribute directly toward spanning a gap.

Known suspension bridges have another burden or problem, namely piers in a watercourse, that the present invention is directed toward alleviating. Piers somewhat obstruct river and tidal flow, especially ice flow, all aggravated by temporary structures needed during bridge construction. Also, piers and their foundations must be positioned and constructed with reserve capacity to withstand ice forces, flow turbulence and especially an undercutting or scouring tendency. The reserve capacity increases the size and cost of foundations and piers.

Piers also are a navigation hazard posing risk of losing a ship or a bridge itself and lives of travellers. Ship collisions with piers and bridges have resulted from poor visibility, storms, treacherous currents, unclear signals and human error. A bridge collapse not only blocks crossing and shipping traffic, but brings hardship to a region, and poses strategic problems for military and naval authorities. Piers in a busy seaport or lake therefore are a concern for port authorities, and periodically are subjects of public debate, with stress on security.

A further problem of known suspension bridges is that cables have a uniform cross section, thus uniform strength, but cable tension changes along its length from a maximum at each tower to a minimum at mid span. As is well known, tapering of cables if achievable would proportion the weight of cable to the load at progressive points along the cable, thus bringing economy in cable weight and cost. The present invention addresses this problem, not directly by tapering the cables, but by distributing load to different systems of cables as will be described. As is well known, the ultimate strength of a given weight of wire increases as it is drawn thinner, and an economical size for conventional suspension-bridge cables is found to be about 0.20 inch (5 mm) diameter because the thicker the wire the less length there is to be spun to make up a cable of the necesary diameter. In the present invention, the subdivision of loads, and the separate support of these loads by individual systems of cables all act as a substitute for tapered cables. Therefore, less wire is needed than for conventional main cables, and the use of thinner wire becomes practical with greater strength for a given weight of wire.

SUMMARY OF INVENTION

One aim of the present invention is to help overcome the aforementioned problems of conventional suspension bridges, and especially piers, by introducing a method and apparatus for replacing conventional towers and piers with other means. Such a bridge could span as well a canyon, a railroad yard, a quantity of buildings and any space where spanning without piers is desirable. A prime aim of the present invention therefore is to increase the span between foundations of a suspension bridge compared to known art. For gaps beyond the capacity of a single span, multiples are possible, whereby the number of spans and piers are decreased from known art. The aforementioned problems and hazards are decreased accordingly. This bridging principle of utilizing booms or spars may be used, for example, with electric power cables spanning a river.

Referring to some preferred embodiments in the present invention, long booms or spars leaning out from shore provide crests equivalent to tower tops for draping cables shore-to-shore. The booms in a sense are towers relocated. The lean is supported by separate cables reaching from a boom top to an anchorage inland. A boom rests on a base at shore instead of on a pier, somewhat like a boom on a mechanical crane or derrick, with the bottom of the boom resting on the base and the top of the boom supported by cables anchored back. Normally, a bridge boom would be made dual to straddle a path similar to known towers straddling a path, except that booms would lean over water versus towers being vertical in water.

Just as a tower is a compression member of a suspension bridge, and the cables are tension members, so is a boom in the present invention a compression member and cables the tension members.

Although all hanger cables to the deck structures in the embodiments shown may be vertically disposed, as is common in suspension bridges, it is preferable to utilize inclined or diagonal bracing for some hangers, in this instance fanning out from a crest at a boom top. Besides dampening oscillations, diagonals help to support a deck for a distance beyond a boom, thereby shortening the deck part to be supported solely by the main cables.

Turning now to the broad issues of the present invention, tapering of cables, if achievable, may be had in substitution by the use of a different means, such as dividing a bridge load into parts and applying a separate cable system to each part. For example, on dividing bridge load into three parts, a first part may be the boom load, a second part the deck load under the boom and a third part the deck load at mid span between the booms.

To this end, a first cable system is anchored inland and reaches to the boom tops, for supporting the lean of each boom over water. A second cable system hangs from each boom top, as a number of fanning-out hangers or diagonal bracing, for supporting the deck under the boom. These diagonals impose a compressive force in the deck, requiring that deck portion to have stiffening, by means such as conventional side trusses. A third cable system comprises the long-spanning or main cables, anchored inland and draped over the boom tops, for supporting load at mid span between the extremities of the diagonal or inclined hangers.

By dividing bridge load into portions as described, and supporting each load portion by a separate cable system, there is more cable cross section near shore than at mid span somewhat as a tapered cable would have more cable cross section near shore than at mid span. If desired, bridge load could be divided into more than three portions and supported by more than three cable systems, for a closer approximation to a smooth taper of an ideal cable rather than a stepped taper of the same.

Cables of the first system reaching directly from the boom tops to anchorages inland form only a small vertical angle between boom and cable. Such a small or acute angle leaves little leverage, with boom base as fulcrum, and such little mechanical advantage dictates a big tension in cables. Therefore, it is preferred to reduce such cable tension, by enlarging the acute vertical angle. Such enlargement is achieved by placing a tower at shore, on substantially the same base as the boom, and draping cables over the tower top as an intermediate support between anchorage and boom top. Summarizing the reaches of a cable system of three parts, the first system reaches the boom tops, the second system reaches from shore to twice the boom projection and only the third system reaches mid span.

Subdividing bridge load does not change the fact that tension in a cable varies from a minimum at mid span to a maximum at a crest where the incline is steepest. A main cable at mid span is horizontal, thus is with zero vertical component, whereas the same cable near a crest has both a horizontal and vertical component yielding a resultant tension greater than tension at mid span.

These three cable systems need not be segregated from one another, but desirably may share loads, for dampening oscillation. For example, considering the second cable system in isolation, the rigid deck under the boom is virtually a swing hung from the boom tops. Any load arriving on the deck would unbalance that swing, unless another support system could offset that oscillation, so it is preferable to utilize vertical as well as inclined hangers for stiffness. Diagonals are well known for dampening oscillation in suspension bridges, but the present invention extends the use of diagonals to help support a deck beyond boom tops, thus helping to close the mid-span gap left for the main cables.

Subdividing bridge load relieves loading on the main cables and releases some of their capacity for longer spanning than heretofore practised in known art. A corollary to a lengthened span for a given loading per unit of length is a given length of span but increased load capacity per unit of length. In the present invention, various well known accessories are required, such as saddles at a tower top to ensure a practical minimum radius for cable curve.

In theory, an idealistic suspension bridge would be one with cables as relatively straight as violin strings and supporting a deck directly on the cables doubling as deck beams. However, violin strings are short, with negligible weight compared to tension, and the formula for sag in a long span uniformly loaded is well known to define a substantial sag.

The substantial sag of bare cables of long span is seen typically in high-voltage electric power cables between transmission towers. Loading a taut clothes line is a demonstration of vertical load causing substantial sag. To support a vertical load, a cable must have a vertical component. Primitive suspension bridges built for crossing on foot could tolerate substantial sag. Wheeled traffic however requires a gentler slope, thus requiring a relatively level deck to be hung off a cable of substantial gas, and the weight of hangers and fastenings accentuate the sag.

Formulae for calculating cable tension appear in textbooks. Weight uniformly distributed along a cable itself cause that cable to assume the curve of a catenary. Weight uniformly distributed along the horizontal causes a cable to assume the curve of a parabola. For the proportions of span and sag in practical bridging, both curves are close together, and as the catenary curve of the cable alone is the more complex to figure, a fortunate situation is that the cable itself is only a small part of the total bridge load. The simpler formula for a parabola therefore serves as practical for calculating cable tension at any point along a sagging cable. Likewise, cable slope at any point may be determined as well as cable length along the curve.

Referring now to important advantages obtained, the present invention makes possible having all construction on shore, instead of partly in water, for spans equivalent to those of known art. This eliminates an important cost of bridge building, because construction of piers in water requires costly equipment and procedures, including costs of inconvenience in temporarily obstructing a waterway. Construction on shore also is safer than construction in water, especially in river and tidal flows, where pile driving and other procedures are timed to the seasons and currents. Further, seasonal changes are a main determinant for construction in water, and the present invention inproves flexibility in seasonal scheduling of bridge building. Without piers to build, construction is quickened, thus returns on bridge investment are quickened.

The mid-span part of the bridge deck is preferably of suspension type, but need not be so, and can be of any of several bridge types such as a through truss. The booms may then double as derricks to lift the mid span, for shipping to pass under, an advantage even when a through truss might have less span than a suspension part at mid gap. Side trusses for stiffness make practical the addition of a second deck level, and for a given aggregate of path width, the deck width may be halved. Floor beams accordingly can be halved in length, with considerable lightening of weight, all contributing toward optimum use of material.

In one aspect of the present invention, there is provided a bridge structure comprising in combination: (a) a first elongated member having one end thereof supported upon a first base and the other free end thereof disposed upwardly of said first base; (b) a first elongated boom-like member supported upon one end thereof, said first elongated boom-like member being disposed angularly relative to said first elongated member whereby the free ends of said first elongated member and said first elongated boom-like member are spaced one from another in a first vertical plane; (c) a first tie means extending preferably between said free ends of said first elongated member and said first elongated boom-like member, second tie means extending preferably between said free end of said first elongated member and a first anchor point spaced from said first base; (d) a second elongated member, said second elongated member having one end thereof supported upon a second base and the other free end thereof disposed upwardly of said second base in similar manner to said first elongated member, said first and second bases being positioned in selected spaced relation one to another; (e) a second elongated boom-like member, said second elongated boom-like member supported upon one end thereof, said second elongated boom-like member being similarly angularly disposed, as said first elongated boom-like member, relative to said second elongated member whereby the free ends of said second elongated member and said second elongated boom-like member are spaced one from another in a second vertical plane substantially parallel spaced from said first vertical plane; (f) third tie means, similar to said first tie means, said third tie means extending preferably between said free ends of said second elongated member and said second elongated boom-like member, fourth tie means, similar to said second tie means, said fourth tie means extending preferably between said free end of said second elongated member to a second anchor point spaced from said second base; and (g) an elongated traffic desk structure disposed below and longitudinally of said first and second elongated boom-like members and supported therefrom via respectively fifth and sixth tie means connected between preferably the free ends of said first and second elongated boom-like members and said deck structure, said fifth and sixth tie means lying respectively in said first and second vertical planes.

In a further aspect of the present invention there is provided a bridge structure comprising in combination: (a) a first elongated member having one end thereof supported upon a first base and the other free end thereof disposed upwardly of said first base; (b) a first elongated boom-like member supported upon one end thereof, said first elongated boom-like member being disposed angularly relative to said first elongated member whereby the free ends of said first elongated member and said first elongated boom-like member are spaced one from another in a first vertical plane; (c) a first tie means extending preferably between said free ends of said first elongated member and said first elongated boom-like member, second tie means extending preferably between said free end of said first elongated member and a first anchor point spaced from said first base whereby an acute angle is formed between said second tie means and said first elongated member; (d) a second elongated member, being similar to said first elongated member, said second elongated member having one end thereof supported upon a second base and the other free end thereof disposed upwardly of said second base in similar manner to said first elongated member, said first and second bases being positioned in selected spaced relation one to another: (e) a second elongated boom-like member being similar to said first elongated boom-like member, said second elongated boom-like member supported upon one end thereof, said second elongated boom-like member being similarly angularly disposed, as said first elongated boom-like member, relative to said second elongated member whereby the free ends of said second elongated member and said second elongated boom-like member are spaced one from another in a second vertical plane substantially parallel spaced from said first vertical plane; (f) third tie means, similar to said first tie means, said third tie means extending preferably between said free ends of said second elongated member and said second elongated boom-like member, fourth tie means similar to said second tie means, said fourth tie means extending preferably between said free end of said second elongated member to a second anchor point spaced from said second base whereby an acute angle is formed between said fourth tie means and said second elongated member; and (g) an elongated traffic deck structure disposed below and longitudinally of said first and second elongated boom-like members and supported therefrom via respectively fifth and sixth tie means connected between preferably the free ends of said first and second elongated boom-like members and said deck structure, said fifth and sixth tie means lying respectively in said first and second vertical planes.

In a further aspect of the present invention there is provided a structure comprising in combination; (a) a first elongated member having one end thereof supported on a first base and the other free end thereof disposed upwardly of said first base; (b) a first elongated boom-like member supported upon one end thereof, said first elongated boom-like member being disposed angularly relative to said first elongated member whereby the free ends of said first elongated member and said first elongated boom-like member are spaced one from another in a vertical plane; (c) a second elongated member having one end thereof supported upon a second base spaced from said first base, the other free end of said second elongated member disposed upwardly of said second base; (d) a second elongated boom-like member supported upon one end thereof, said second elongated boom-like member being disposed angularly relative to said second elongated member whereby the free ends of said second elongated member and said second elongated boom-like member are spaced one from another in said vertical plane and the free ends of said first and second elongated boom-like members extend toward one another; and (e) cable means passing over and supported upon said free ends of said elongated members and elongated boom-like members.

In a further aspect of the present invention there is provided a method of constructing a bridge including the steps of: (a) providing two or more traffic decks and interconnecting the same in tandem arrangement to thereby provide a single elongated traffic deck structure; and (b) suspending each of said decks by a cable system of its own, whereby a load placed on each of said decks is supported by the cable system thereof.

BRIEF DESCRIPTION OF THE DRAWINGS

The invention is illustrated by way of example in the accompanying drawings wherein.

DESCRIPTION OF THE PREFERRED EMBODIMENTS

Figure 4:
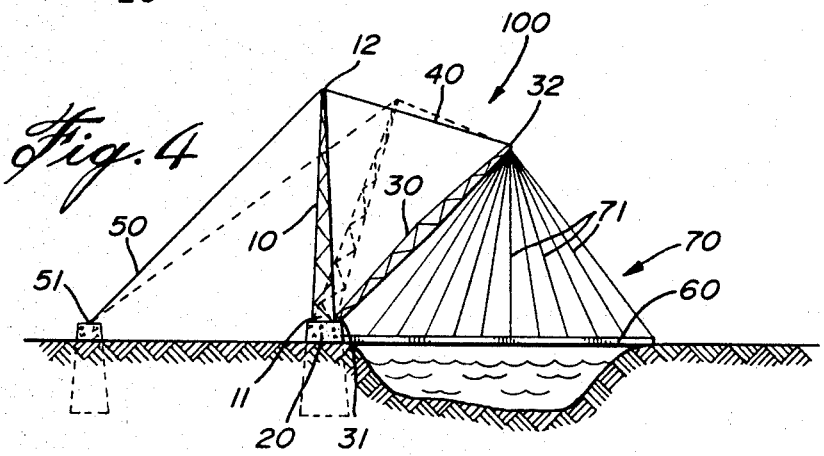
FIG. 4 shows an elevational view of a further bridge structure in accordance with the present invention.
Figure 5:
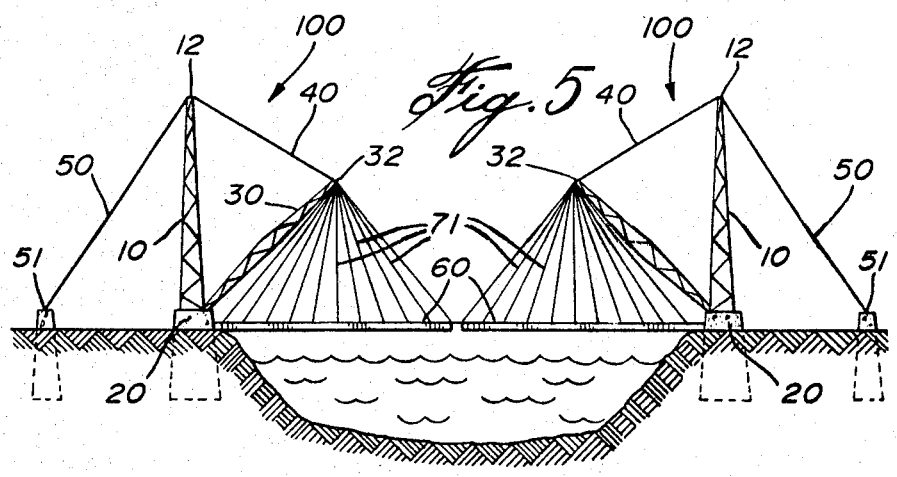
FIG. 5 shows an elevational view of a further bridge structure, in accordance with the present invention.
Figure 6:
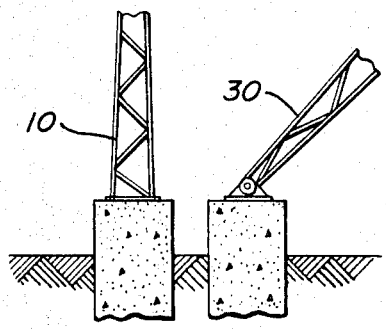
FIG. 6 is a fragmentary view of a member supporting base arrangement in accordance with the present invention.

Referring now in detail to the drawings. FIGS. 4 and 5 illustrate, in effect, modular components of the bridge illustrated in FIG. 1. Such serves to point up the flexibility of the design comprising the present invention.

Figure 3:
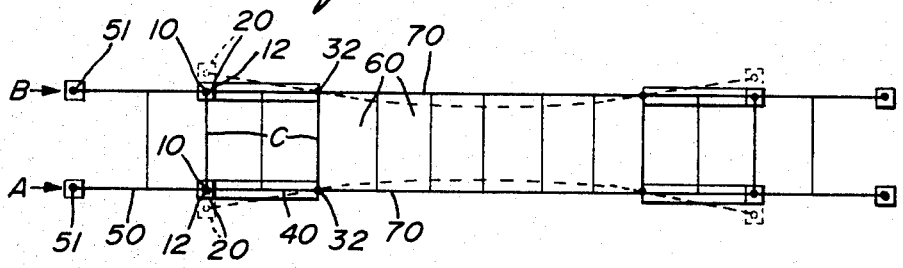
FIG. 3 shows a plan view of the suspension bridge shown in FIG. 2.

Referring to elevational view FIG. 4, and FIG. 3 for the plan view thereof, there is shown a bridge structure 100 having an elongated member 10, having one end 11 thereof supported upon a base 20, the other free end thereof 12 disposed upwardly of base 20. An elongated boom-like member 30 is supported upon one end 31 thereof, member 30 being disposed angularly relative to member 10 whereby the free ends 12 and 32 respectively of members 10 and 30 are spaced one from another in a vertical plane indicated A in FIG. 3.

A tie means 40 extends between free ends 12 and 32 and a tie means 50 extends between free end 12 and an anchor point 51 spaced from base 20, tie means 50 forming an acute angle between it and member 10.

As seen from FIG. 3, showing in addition to other structure, a plan view of FIG. 4, a second and similar aforedescribed structure is spaced in substantially parallel relation thereto and lying in a further vertical plane indicated B in FIG. 3.

As further seen from FIGS. 3 and 4, an elongated traffic deck structure 60 is disposed below and longitudinally of members 30 and supported therefrom via respective tie means 70, each lying respectively in vertical planes A and B and connected between the respective free ends 32 and deck structure 60. Tie means 70 it will be noted comprise a plurality of elongated members depending in fan-like configuration from respective free ends 32 toward deck structure 60. Other suitable depending arrangements may of course be used in place of the one shown, if desired. Likewise, the vertically disposed tie member discussed hereinafter may alternatively depend in non-vertical directions, if desired, and which contributes generally to assist stabilization.

Figure 2:
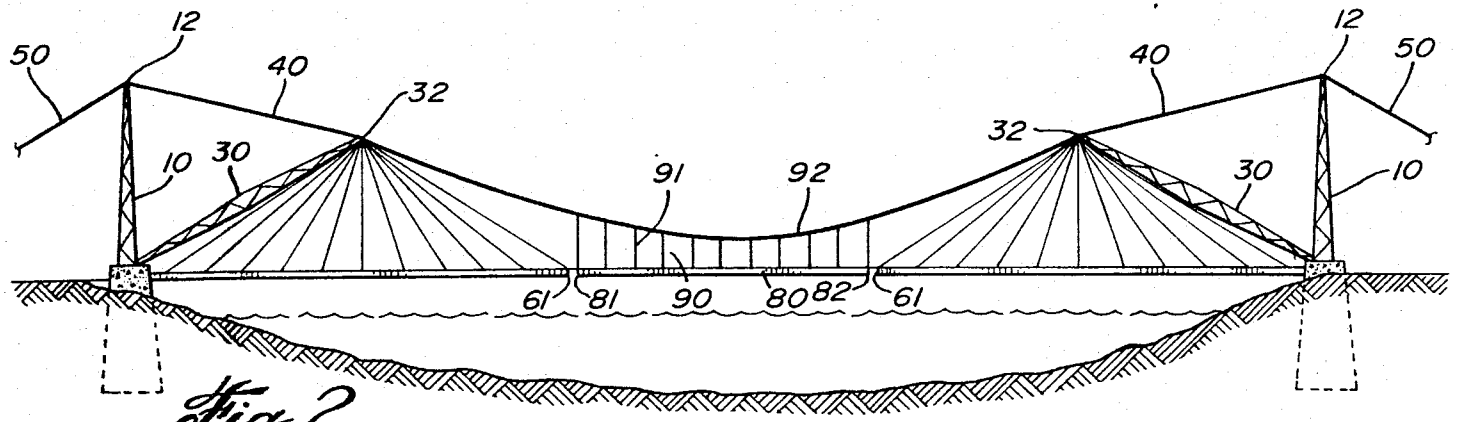
FIG. 2 shows a side elevational view of a suspension bridge in accordance with the present invention.

It will be appreciated, the bridge structures of FIGS. 4 and 5 may be used where limited span lengths are required compared to that shown in FIG. 2.

As seen from FIG. 3, a series of bracings C connect the free ends 32 together and 12 together. Others may interconnect tie means 40 together, 50 together and the two tie means each lying in vertical planes A and B connecting the free ends 32 of the elongated boom members 30 discussed hereinafter. As an alternative, the bracings C may criss-cross one another rather than lie in parallel spaced relation as shown in FIG. 3.

Elongated member 10 as seen in FIGS. 3 and 4, is an upstanding mast-like member. Although shown in a vertical plane, see FIG. 4, such could, of course, if desired, be mounted slightly inclined or substantially inclined to the vertical plane, one example being shown by dotted line in FIG. 4. Member 10 may be constructed from any suitable well-known materials and comprise for example girder-type construction. Member 10 is secured by suitable means to base 20 including bolting arrangements not shown.

Base 20 may comprise any suitable material including reinforced concrete. If desired, the two bases 20 spaced laterally of the deck structure 60 may be tied together using additional concrete and reinforcing to thereby form a single base.

Figure 7:
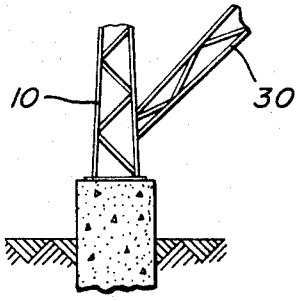
FIG. 7 is a fragmentary view of a member supporting arrangement, in accordance with the present invention.

Elongated boom-like member 30 may comprise similar materials and be constructed in similar manner to that of elongated member 10, and also be mounted upon and secured to base 20 in similar manner to that of elongated member 10. Alternatively, each of elongated boom-like members 30 may be secured and mounted to an independent base positioned adjacent base 20 as shown in FIG. 3. As a further alternative, elongated boom-like member 30 may be mounted and secured to elongated member 10, for example, adjacent the base end thereof, as shown in FIG. 7.

Tie means 40 may comprise any suitable type including cable means of suitable well-known type and preferably is secured to free ends 12 and 32 in any suitable well-known manner. Alternatively, tie means 40 may be secured to points on members 10 and 30 adjacent to and also remote from said free ends. Tie means 40, like other tie means discussed hereinafter in respect of the preferred embodiments disclosed and, is of uniform cross-section throughout its length. As indicated elsewhere, this is an important aspect afforded by the present design. Securement of tie means 40 may be achieved by any suitable well-known means, not shown.

Tie means 50 is similar to tie means 40 and is secured in the case of the preferred embodiments shown, into the ground via an anchor means 50 of suitable known type and which may include a reinforced concrete abutment. Again, securement of tie means 50 is similar to that of tie means 40.

Elongated traffic deck structure 60 may be of any suitable type including known designs comprising welded-together beams and girders and include a traffic surface such as grating, concrete, etc. If desired, structure 60 may extend outwardly of bases 20 to a greater extent than member 30 of its associated base 20, as shown in FIG. 4. Further, structure 60 may extend to terminate at one end thereof adjacent bases 20, as shown in FIG. 4.

Tie means 70, like tie means 40 and 50, may comprise cable means of suitable type, in the present instance, cable members 71 and secured by well-known means to respective members 30 adjacent respective free ends 32 and structure 60.

Referring now to FIG. 5, such illustrates a further bridge structure utilizing two of the structures 100 shown in FIG. 4 arranged one to another such that elongated boom-like members 30 extend to face one another and the elongated traffic deck structures 60 extend to permit connection therebetween by suitable means, not shown, accordingly to provide a single elongated traffic deck structure.

Figure 1:
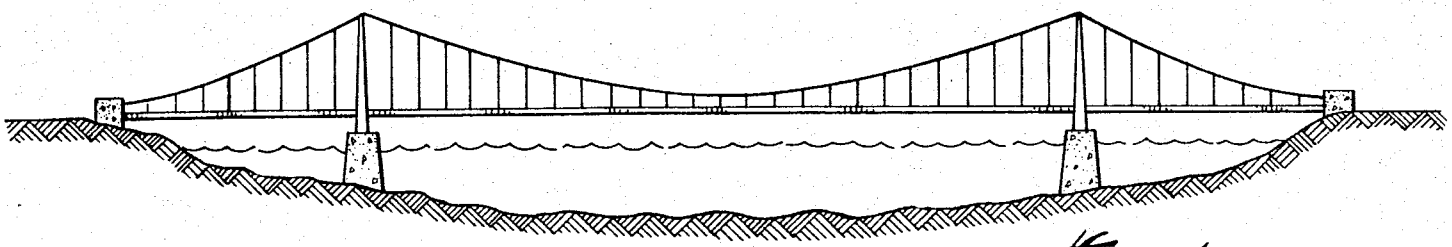
Fig. 1 (PRIOR ART)
FIG. 1 shows a side elevational view of a prior art conventional suspension bridge.

Referring now to FIG. 2, such is noted to show a bridge spanning a river of similar width spanned by the bridge shown in FIG. 1 and yet having no piers in the river. Further, it is to be noted free ends 32 (peaks) correspond to peaks of the pier-mounted towers or masts of the FIG. 1 bridge construction.

It will be noted the bridge structure of FIG. 2 is again a modification of the FIG. 5 bridge structure, mainly displacing bridge structures 100 to insert therebetween a further elongated traffic deck structure 80, being of similar construction to that of structure 60. Traffic deck structure 80 is interconnected adjacent respective ends thereof 81 and 82 to the respective free ends 61 of structures 60. The interconnections may permit independent movement of the various deck structures one to another.

Structure 80 is supported by a pair of further tie means 90, one lying in vertical plane A and the other lying in vertical plane B, each comprising a plurality of elongated vertically disposed and parallel spaced members 91. Members 91 are connected adjacent one end thereof to structure 90 and at the opposite end thereof to further tie means 92, one tie means 92 being in vertical plane A and the other in vertical plane B and connected respectively to ones of free ends 32 of elongated boom-like members 30. As noted, tie means 92 sag in catenary fashion between the respective free ends 32. The catenary configuration of course may vary depending upon requirements. Referring to FIG. 3, planes A and B are shown parallel to one another. In some instances, it may be desirable, for example at mid span of the bridge, to narrow the width between the tie means 90 in which case planes A and B would be substantially parallel to one another. The said narrowing (within limits) may be used in order to provide improved stability to a bridge in a crosswind. Reference is made to FIG. 3 which illustrates such narrowing by dotted line and may also involve displacing the bases 20, members 10 and 30, further apart outwardly of the traffic deck structure. A further variation may include providing an alternative location for anchor means 51 in terms of its elevation respective base 20. A further variation to the embodiments disclosed may comprise the free ends 32 being on a common elevation with those of free ends 12 or above the same.

From the foregoing, it will be evident that for example, in the FIG. 2 embodiment, three deck structures are provided wherein each is supported by a system. It may be said in this instance, three systems are provided, the first comprising the tie means extending between the free ends of the respective elongated members and associated respective elongated boom-like members, the second comprising the tie means supporting deck structures 60 and the third, the tie means supporting deck structure 80. As indicated, the interconnection between the deck structures may be such as to permit independent movement thereof, one to another. An overlapping or sharing of the systems may also be utilized for dampening oscillation of the bridge structures.

As mentioned, the present invention also provides structure for supporting, for example, electric power cables across a river or the like so that piers are not placed in the river water. Besides electric power cables, it is envisaged such structure might support ski lift, aerial conveyor or pipeline cables. Such structure may consist merely of a pair of elongated members 10, a pair of associated elongated boom-like members 30 supported upon respective bases 20 all arranged in the manner shown in FIG. 2, for example, and wherein the power cables pass over and are supported upon free ends 12 and 32. Tie means 50 may be included in such arrangement and three free ends 12 and 32 similarly positioned as seen in FIG. 2, allowing the power cables or cable to form a catenary along a path as defined by the tie means 40 and 92. In plan view, such structure would resemble that shown in FIG. 3 looking along plane A.

Figure 8:
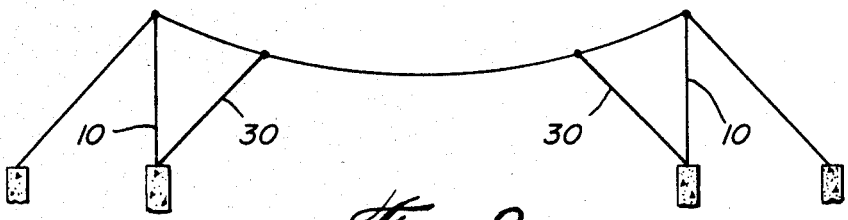
FIG. 8 is a side elevational view of a cable supporting structure in accordance with the present invention.
Figure 9:
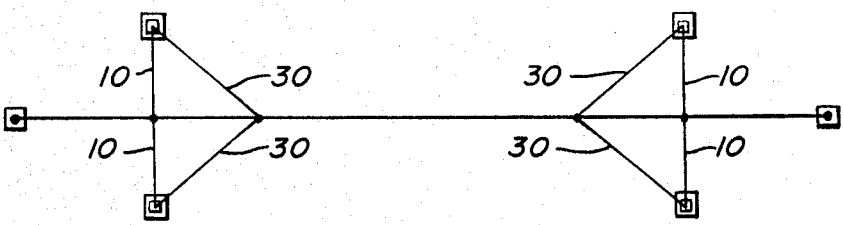
FIG. 9 is a plan view of the structure shown in FIG. 8.

The structure for supporting said cables may also comprise where the elongated members 10 comprise four in number and each pair thereof are inclined toward one another as an "A" frame, the elongated boom-like members 30 likewise comprising four in number and inclining toward one another as an "A"-frame. Such is shown in FIGS. 8 and 9.

As may be realized, the structures discussed above for use in supporting said cables may include elongated members 10 which are free-standing or stayed, including by tie means.

I claim:

1. A bridge structure comprising in combination:

(a) a first elongated compression member having one end thereof supported upon a first base and the other free end thereof disposed upwardly of said first base;

(b) a first elongated boom-like compression member supported upon one end thereof, said first elongated boom-like compression member being disposed angularly relative to said first elongated compression member whereby the free ends of said first elongated compression member and said first elongated boom-like compression member are spaced one from another in a first vertical plane;

(c) a first tension tie means having a fixed length extending between said free ends of said first elongated compression member and said first elongated boom-like compression member, whereby to connectedly support said first elongated boom-like compression member off said first elongated compression member, a second tension tie means having a fixed length extending between said free end of said first elongated compression member and a first anchor point spaced from said first base whereby an acute angle is formed between said second tension tie means and said first elongated compression member;

(d) a second elongated compression member, being similar to said first elongated compression member, said second elongated compression member having one end thereof supported upon a second base and the other free end thereof disposed upwardly of said second base in similar manner to said first elongated compression member, said first and second bases being positioned in selected spaced relation one to another;

(e) a second elongated boom-like compression member supported upon one end thereof, said second elongated boom-like compression member being similarly angularly disposed, as said first elongated boom-like compression member, relative to said second elongated compression member whereby the free ends of said second elongated compression member and said second elongated boom-like compression member are spaced one from another in a second vertical plane substantially parallel spaced from said first vertical plane;

(f) a third tension tie means having a fixed length, similar to said first tension tie means, said third tension tie means extending between said free ends of said second elongated compression member and said second elongated boom-like compression member, whereby to connectedly support said second elongated boom-like compression member off said second elongated compression member, fourth tension tie means having a fixed length, similar to said second tension tie means, said fourth tension means extending between said free end of said second elongated compression member to a second anchor point spaced from said second base whereby an acute angle is formed between said fourth tension tie means and said second elongated compression member; and (g) an elongated traffic deck structure, comprising a rigid deck truss, disposed below and longitudinally of said first and second elongated boom-like compression members and supported from above via respectively fifth and sixth tension tie means connected between the free ends of said first and second elongated boom-like compression members and said deck structure, said fifth and sixth tension tie means lying respectively in said first and second vertical planes and comprising a plurality of elongated tension members depending in fan-like configuration toward said deck structure.

2. A bridge structure as defined in claim 1, including a second of said bridge structures, the two bridge structures being arranged one to another such that the first and second elongated boom-like compression members of each bridge structure extend to face one another and the elongated traffic deck structures of each bridge structure are interconnected one to another to thereby provide a single elongated traffic deck structure.

3. A bridge structure as defined in claim 2, including a further elongated traffic deck structure intermediate and interconnected to said elongated traffic deck structures, said further elongated traffic deck structure being inserted therein to thereby provide an extended single elongated traffic deck structure, said further elongated traffic deck structure being supported by seventh and eighth tension tie means extending respectively in said first and second vertical planes, said seventh tension tie means comprising a plurality of elongated members each of which has one end which is secured to said further traffic deck structure and opposite end thereof secured to a ninth tension tie means lying in said first vertical plane, said eighth tie means comprising a plurality of elongated members each of which has one end which is secured to said further traffic deck structure and the opposite end thereof secured to a tenth tension tie means lying in said second vertical plane, said ninth and tenth tension tie means each comprising an elongated member extending in a sagging catenary fashion between respective ones of said elongated boom-like compression members.

4. A bridge structure as defined in claim 3, wherein said seventh and eighth tension tie means comprise vertically disposed elongated members positioned in spaced parallel relation one to another.

5. A bridge structure as defined in claim 1, wherein said tie means comprises cable means.

6. A bridge structure as defined in claim 1, wherein said first and second bases are interconnected one to another to thereby form a single base.

7. A bridge structure as defined in claim 1, wherein said first and second elongated compression members comprise vertically disposed towers.

8. A bridge structures as defined in claim 1, wherein said elongated traffic deck structure extends outwardly of said first and second bases to a greater extent than said elongated boom-like compression members.

9. A bridge structure as defined in claim 1, wherein said elongated traffic deck structure terminates at one end thereof, adjacent said first and second bases.

10. A bridge structure comprising in combination;

(a) a first elongated compression member having one end thereof supported upon a first base and the other free end thereof disposed upwardly of said first base;

(b) a first elongated boom-like compression member supported upon one end thereof, said first elongated boom-like compression member being disposed angularly relative to said first elongated compression member whereby the free ends of said first elongated compression member and said first elongated boom-like compression member are spaced one from another in a first vertical plane;

(c) a first tension tie means having fixed length extending between said free ends of said first elongated compression member and said first elongated boom-like compression member, whereby to connectedly support said first elongated boom-like compression member off said first elongated compression member, second tension tie means having a fixed length extending between said free end of said first elongated compression member and a first anchor point spaced from said first base;

(d) a second elongated compression member, being similar to said first elongated compression member, said second elongated compression member having one end thereof supported upon a second base and the other free end thereof disposed upwardly of said second base in similar manner to said first elongated compression member, said first and second bases being positioned in selected spaced relation one to another;

(e) a second elongated boom-like compression member supported upon one end thereof, said second elongated boom-like compression member being similarly angularly disposed, as said first elongated boom-like compression member, relative to said second elongated compression member whereby the free ends of said second elongated compression member and said second elongated boom-like compression member are spaced one from another in a second vertical plane substantially parallel spaced from said first vertical plane;

(f) third tension tie means having a fixed length, similar to said first tension tie means, said third tension tie means extending between said free ends of said second elongated compression member and said second elongated boom-like compression member, whereby to connectedly support said second elongated boom-like compression member off said second elongated compression member, fourth tension tie means having a fixed length, similar to said second tension tie means, said fourth tension tie means extending between said free end of said second elongated compression member to a second anchor point spaced from said second base; and (g) an elongated traffic deck structure, comprising a rigid deck truss, disposed below and longitudinally of said first and second elongated boom-like compression members and supported from above via respectively fifth and sixth tension tie means connected between the free ends of said first and second elongated boom-like compression members and said deck structure, fifth and sixth tension tie means lying respectively in said first and second vertical planes and comprising a plurality of elongated tension members depending in fan-like configuration toward said deck structure.

11. A bridge structure as defined in claim 1 wherein said first elongated boom-like compression member one end is supported upon said first base and said second elongated boom-like compression member one end is supported upon said second base.

12. A bridge structure as defined in claim 1 wherein said first and second anchor points are located on a similar elevation to that of said first and second bases.

13. A bridge structure as defined in claim 5 wherein said cable means comprise cables having uniform diameter throughout their extended length.

14. A bridge structure as defined in claim 1 wherein said free ends of said first and second elongated boom-like compression members terminate at an elevation below said free ends of said first and second elongated compression members.

15. A bridge structure as defined in claim 12 wherein said respective supported one ends are located adjacent one another.

16. A bridge structure as defined in claim 1 wherein said first and second elongated boom-like compression members are secured respectively to said first and second elongated compression members.

17. A bridge structure as defined in claim 2 wherein said interconnection of said elongated traffic decks one to another permits independent movement of one elongated traffic deck to another.

18. A structure comprising in combination:

(a) a first elongated compression member having one end thereof supported on a first base and the other free end thereof disposed upwardly of said first base;

(b) a first elongated boom-like compression member supported upon one end thereof, said first elongated boom-like compression member being disposed angularly relative to said first elongated compression member whereby the free ends of said first elongated compression member and said first elongated boom-like compression member are spaced one from another in a vertical plane;

(c) a second elongated compression member having one end thereof supported upon a second base spaced from said first base, the other free end of said second elongated compression member disposed upwardly of said second base;

(d) a second elongated boom-like compression member supported upon one end thereof, said second elongated boom-like compression member being disposed angularly relative to said second elongated compression member whereby the free ends of said second elongated compression member and said second elongated boom-like compression member are spaced one from another in said vertical plane and the free ends of said first and second elongated boom-like compression members extend toward one another; and (e) cable means secured to and supported by said free ends of said elongated compression members and elongated boom-like compression members thereby to provide a first tie means having a fixed length extending between the free end of one elongated compression member and the free end of its associated and adjacent elongated boom-like compression member and a second tie means having a fixed length extending between the free end of said other elongated compression member and the free end of its associated and adjacent elongated boom-like compression member, whereby to connectedly support said elongated boom-like compression members off their respective adjacent elongated compression members.

19. A structure as defined in claim 18, wherein said first and second elongated boom-like compression members are supported upon respectively said first and second bases.

20. A structure as defined in claim 18, wherein said first and second elongated compression members comprise vertically disposed towers.

21. A structure as defined in claim 18, including a further of said structures positioned in spaced parallel arrangement therewith, whereby in plan view, said bases define the corners of an imaginary rectangle, said two structures are inclined toward one another such that the free ends of the respective elongated members and the elongated boom-like compression members are interconnected to provide a series of "A" frame structures for supporting thereof adjacent said free ends, said cable means extending in a plane passing intermediate said bases.

22. A bridge structure as defined in claim 1 including tie means extending between ones of said elongated compression members and ones of said elongated boom-like compression members.

23. A bridge structure as defined in claim 1 including tie means extending between the free ends of ones of said elongated compression members and the free ends of ones of said elongated boom-like compression members.

* * * * *